US006168464B1

(12) United States Patent
Choy et al.

(10) Patent No.: US 6,168,464 B1
(45) Date of Patent: Jan. 2, 2001

(54) SECUREMENT ARRANGEMENT FOR SLANTED TYPE CARD EDGE CONNECTOR

(75) Inventors: Edmond Choy, Union City; Jeng-Yih Hwang, Irvine, both of CA (US)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/558,246

(22) Filed: Apr. 25, 2000

Related U.S. Application Data

(63) Continuation of application No. 09/016,144, filed on Jan. 30, 1998, now Pat. No. 6,086,416.

(51) Int. Cl.[7] ..... H01R 13/60
(52) U.S. Cl. ..... 439/567
(58) Field of Search ..... 439/83, 567, 570, 439/571, 326

(56) References Cited

U.S. PATENT DOCUMENTS 5,297,966 * 3/1994 Brennian, Jr. et al. ..... 439/570
5,387,115 * 2/1995 Kozel et al. ..... 439/567

* cited by examiner

*Primary Examiner*—Paula Bradley
*Assistant Examiner*—Briggitte R. Hammond
(74) *Attorney, Agent, or Firm*—Wei Te Chung

(57) ABSTRACT

A slanted type card edge connector (10) includes an insulative housing (12) defining a central slot (14) for receiving a module therein. Two rows of contacts (18, 19) are provided by two sides of the central slot (14) with tails (20) extending horizontally out of the front surface (22) and the rear surface (24) of the housing (12). The housing (12) includes three securement sections (30) respectively essentially positioned on two opposite ends and the middle portion. A pair of mounting pads (46) and a positioning holdown (38) are provided with each securement section (30) wherein one mounting pad (46) extends horizontally and forward out of the front surface (22) of the housing (12) and the other mounting pad (46) extends horizontally and rearward out of the rear surface (24) of the housing (12) while the holdown (38) extending downward, thus resulting in a condition that the positioning holdown (38) is generally positioned between the corresponding front side mounting pad (46) and rear side mounting pads (46) and substantially keeps the same distance with regard to such two mounting pads (46). Therefore, such pair of mounting pads (46) cooperating with the center holdown (38) can provide a counterbalance with each other for efficiently resisting severe unusual insertion or withdrawal of the card with regard to the connector (10).

6 Claims, 10 Drawing Sheets

SECUREMENT ARRANGEMENT FOR SLANTED TYPE CARD EDGE CONNECTOR (This is a continuation application of the application Ser. No. 09/016,144 filed Jan. 30, 1998 now U.S. Pat. No. 6,086,416.)

BACKGROUND OF THE INVENTION

1. Field of The Invention

The invention relates to slanted type card edge connectors, and particularly to the slanted type connector having surface mount type contact tails and the corresponding securement device for mounting to the mother board.

2. The Related Art

The copending Ser. No. 08/910,376 filed Aug. 13, 1997 discloses a 25-degree slanted type DIMM (Dual In-line Memory Module) card edge connector with two rows of SMT (Surface Mount Technology) type contacts by two sides, wherein three solder pads are disposed on the front side cooperating with three post for securing the connector on the mother board. Anyhow, one concern has been raised whether the securement is sufficient to resist the bending moment, which is generated by insertion or withdrawal of the module or card with regard to the connector, imposed on rear side portions of the connector with the mother board. In such practice, apparently no reliable securement device is provided on the rear side of the connector to resist the bending moment imposed thereon.

Therefore, an object of the invention is to provide a slanted type card edge connector with the securement device on both front and rear sides for not only efficiently resisting the bending moment imposed thereabout, but also for reliably protecting the horizontally ex tending SMT type contact tails during delivery.

SUMMARY OF THE INVENTION

According to an aspect of the invention, a slanted type card edge connector includes an insulative housing defining a central slot for receiving a module or a card therein. Two rows of contacts are provided by two sides of the central slot with solder tails extending horizontally out of the front surface and the rear surface of the housing. The housing includes three securement sections respectively essentially positioned on two opposite ends and the middle portion. A pair of mounting pads and a positioning holdown are provided with each securement section wherein one mounting pad extends horizontally and forward out of the front surface of the housing and the other mounting ad extends horizontally and rearward out of the rear surface of the housing while the holdown extending downward, thus resulting in a condition that the positioning holdown is generally positioned between the corresponding front side mounting pad and rear side mounting pads and substantially keeps the same distance with regard to such two mounting pads. Therefore, such pair of mounting pads cooperating with the center holdown can provide a counterbalance with each other for efficiently resisting severe unusual insertion or withdrawal of the card with regard to the connector.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
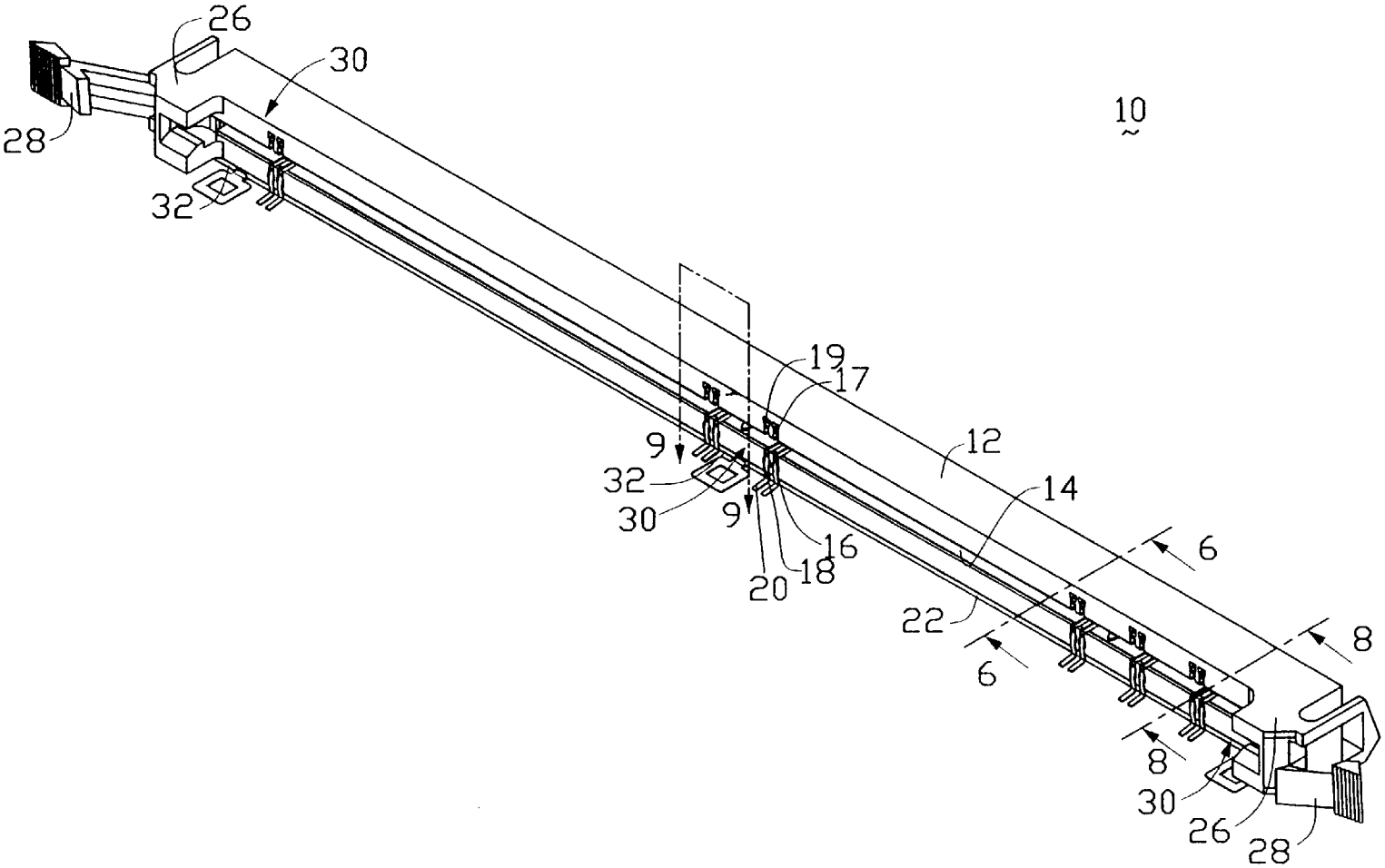
FIG. 1 is a front perspective view of a presently preferred embodiment of a slanted type DIMM connector according to the invention.
Figure 2:
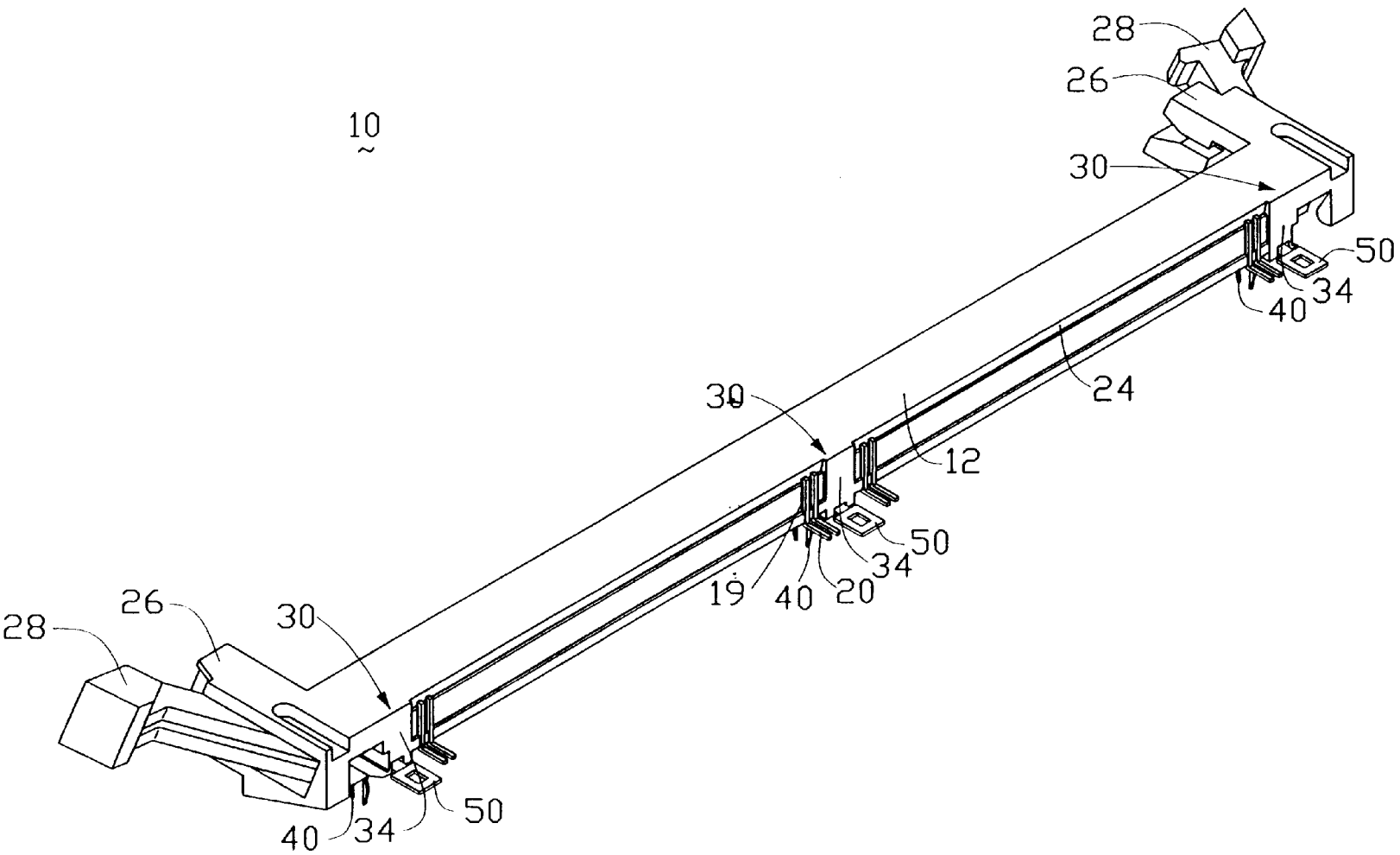
FIG. 2 is a rear perspective view of the slanted type DIMM connector of FIG. 1.
Figure 3:
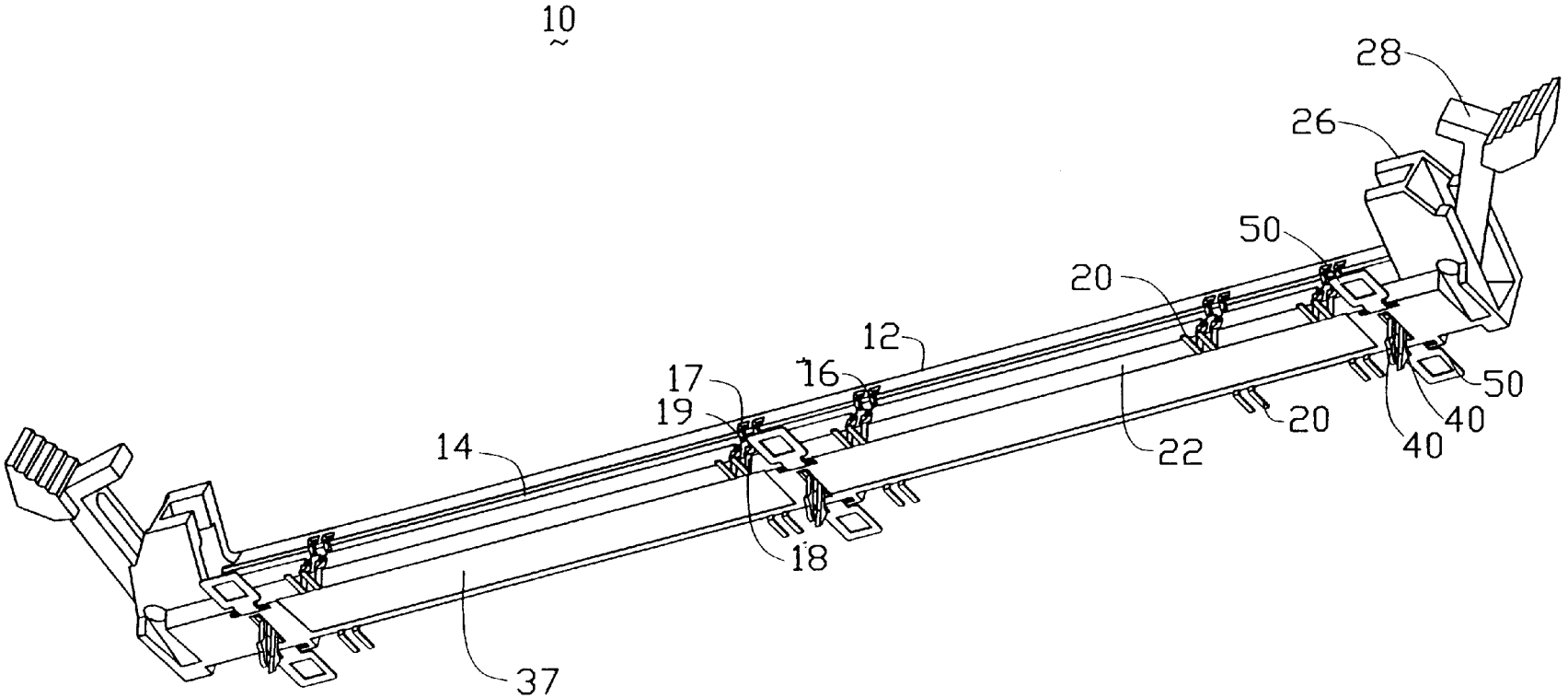
FIG. 3 is a bottom perspective view of the slanted type DIMM connector of FIG. 1.
Figure 4:
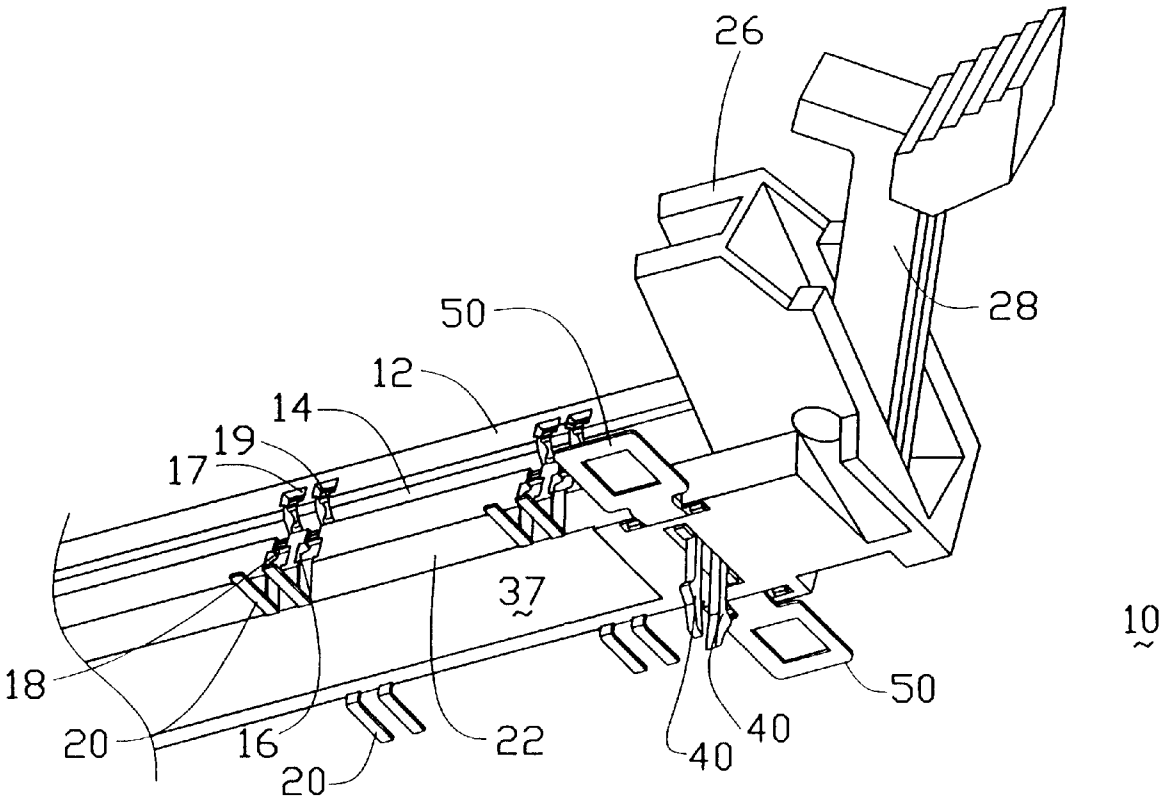
FIG. 4 is a partial enlarged bottom perspective view of the slanted type DIMM connector of FIG. 1.
Figure 5:
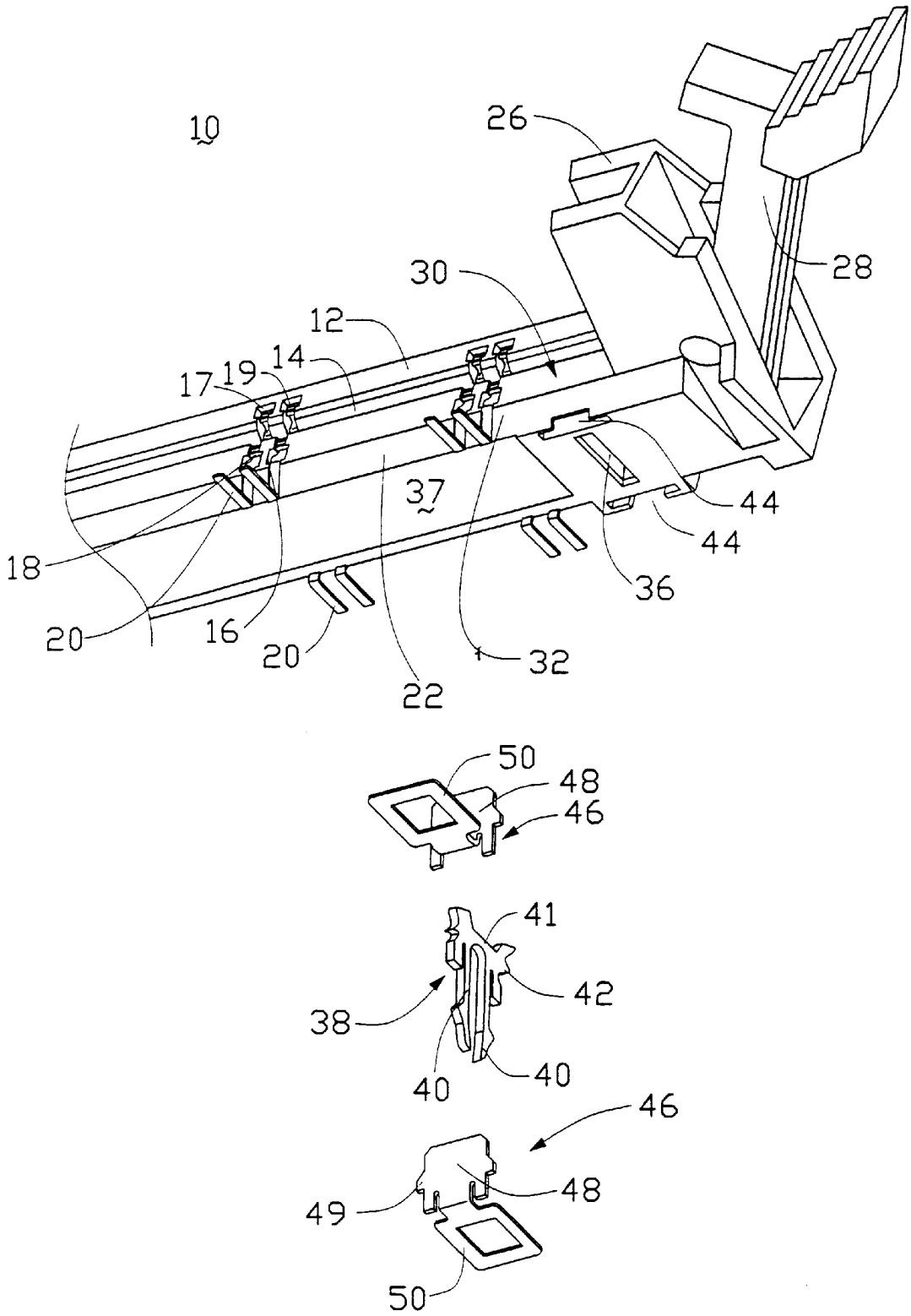
FIG. 5 is a partial enlarged bottom perspective view of the slanted type DIMM connector of FIG. 1 wherein the holdown and the mounting pads are disassembled therefrom.
Figure 6:
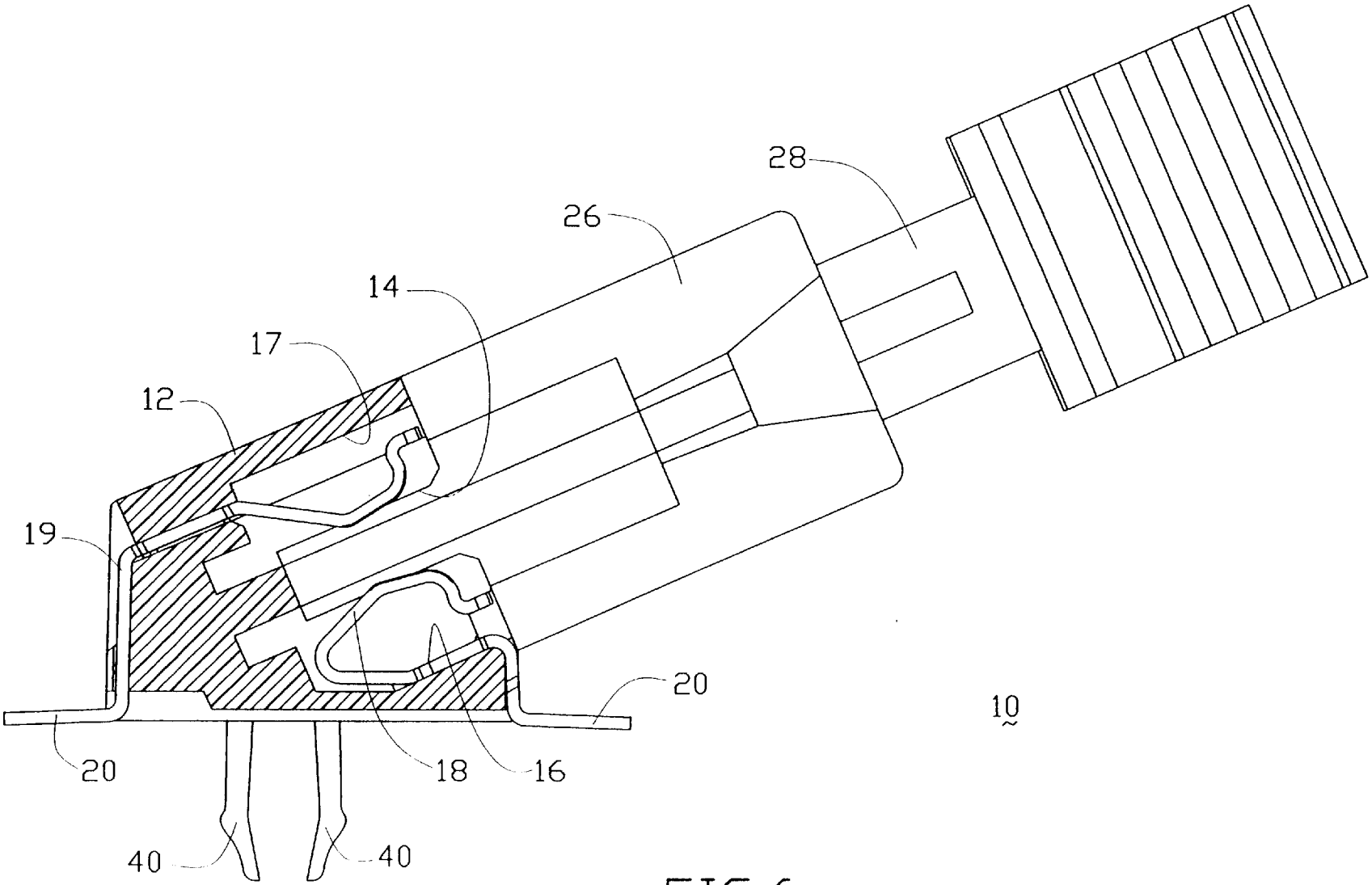
FIG. 6 is a cross-sectional view of the slanted type DIMM connector of FIG. 1 along line 6—6.
Figure 7:
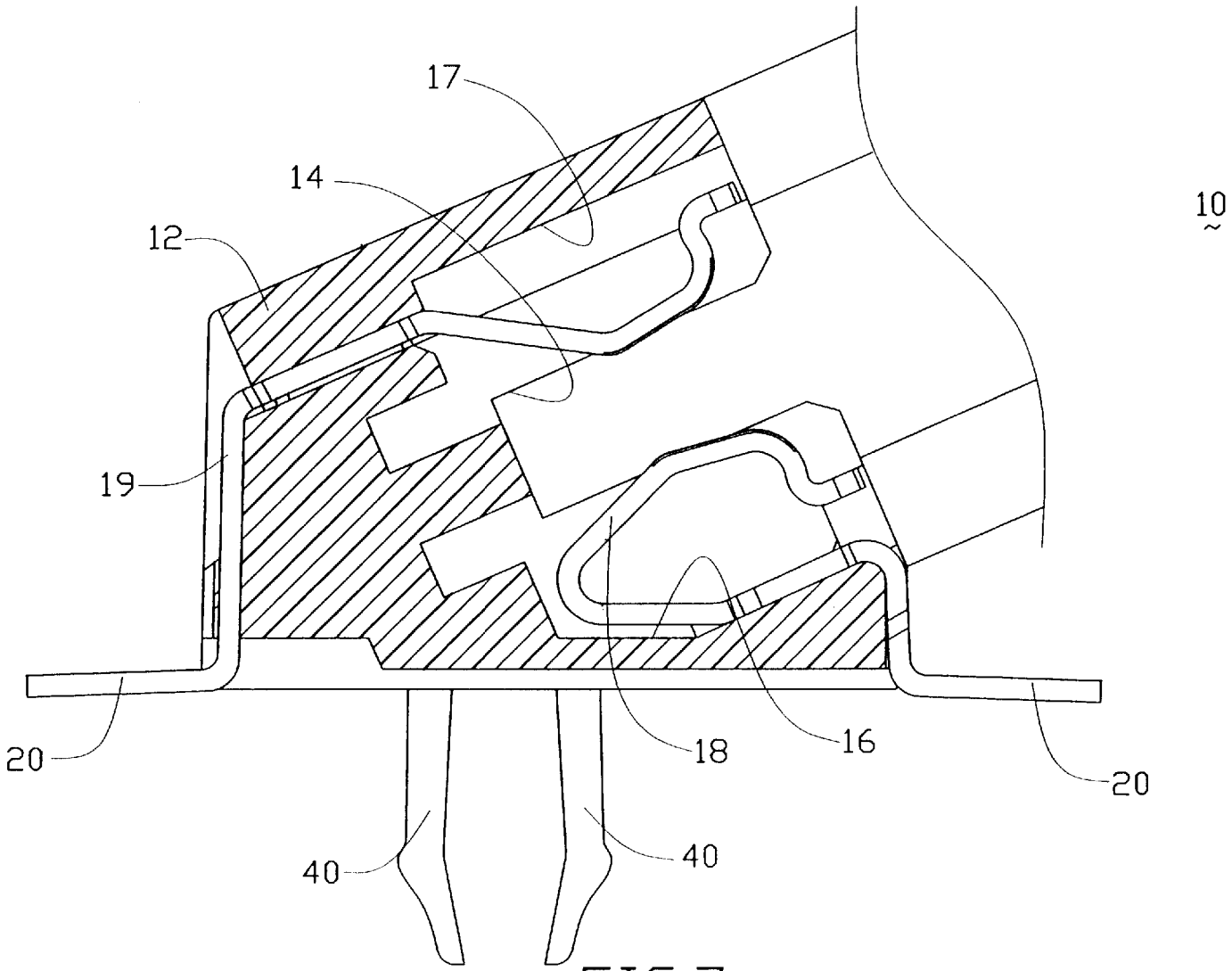
FIG. 7 is a partial enlarged cross-sectional view of the slanted type DIMM connector of FIG. 1 along line 6—6.
Figure 8:
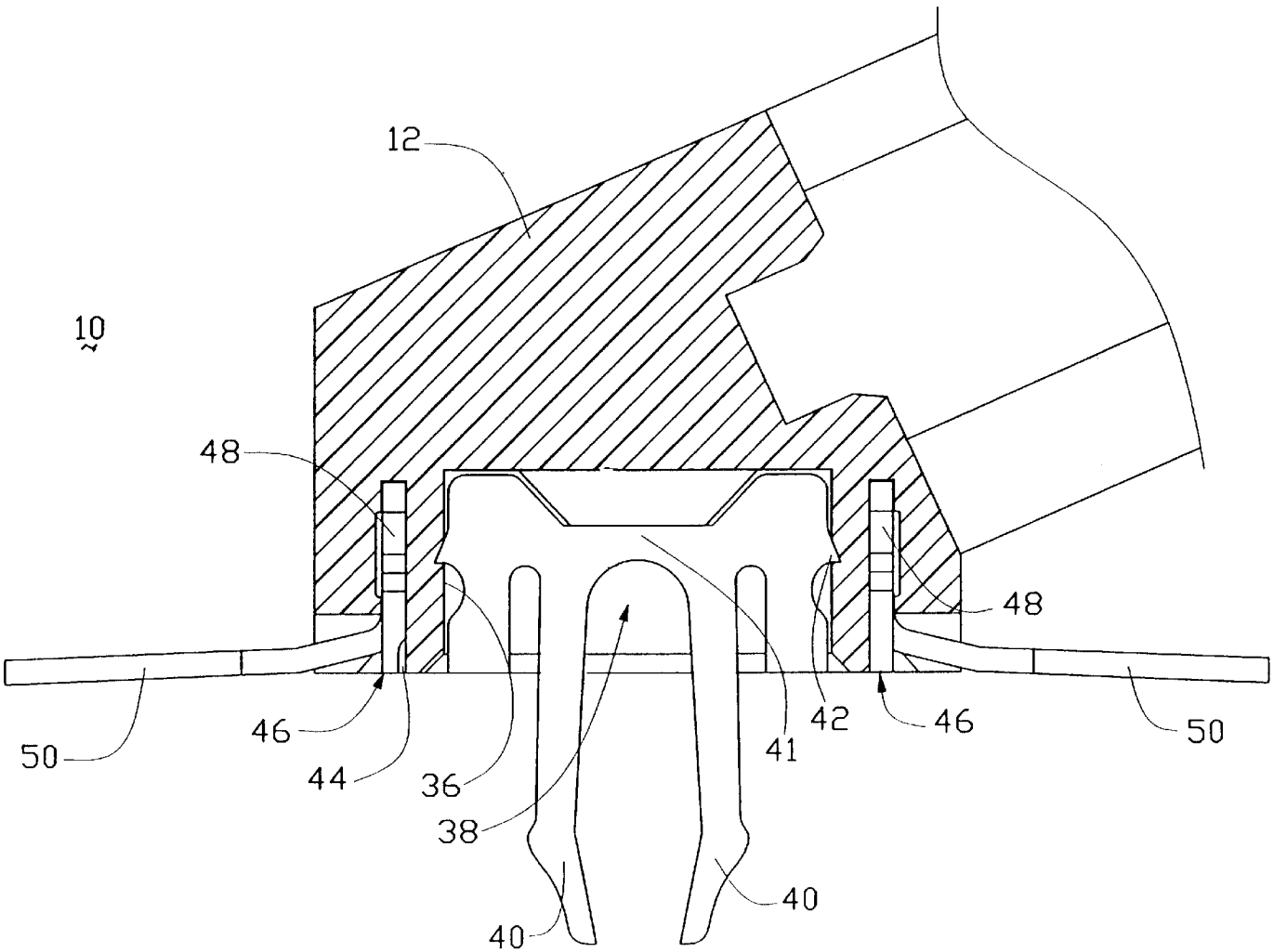
FIG. 8 is a partial enlarged cross-sectional view of the slanted type DIMM connector of FIG. 1 along line 8—8.
Figure 9:
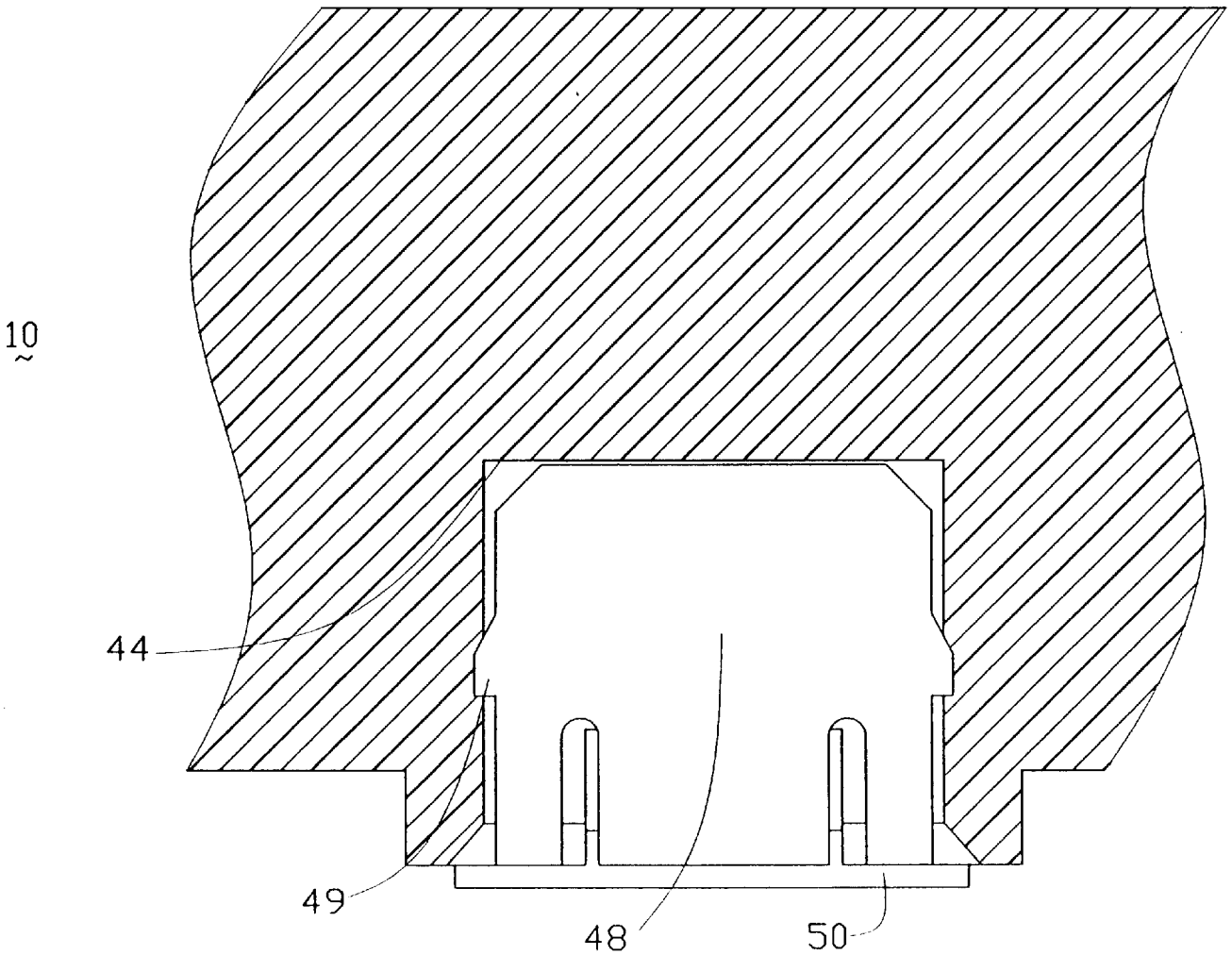
FIG. 9 is a partial enlarged cross-sectional view of the slanted type DIMM connector of FIG. 1 along line 9—9.
Figure 10:
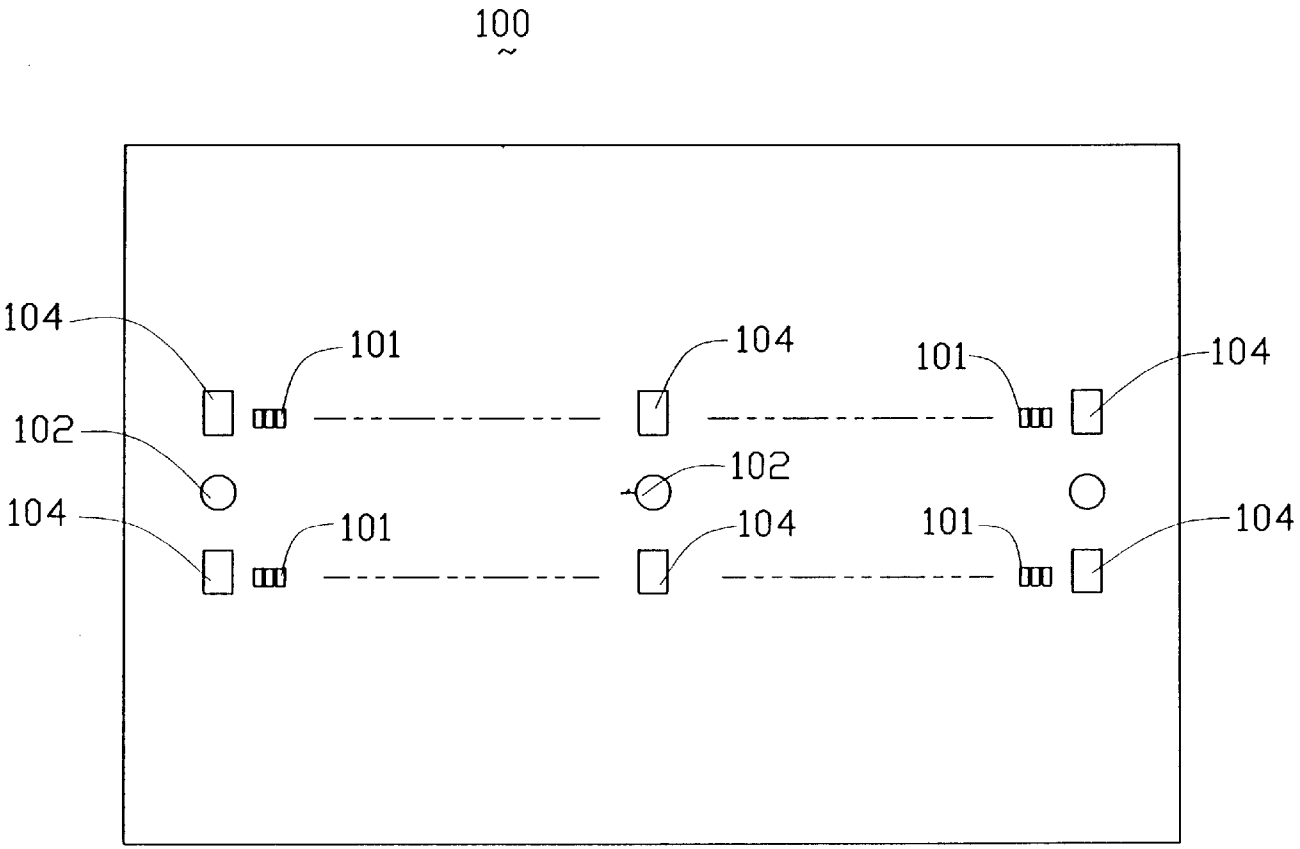
FIG. 10 is a plan view of a mother board on which the connector of FIG. 1 is adapted to be seated.

It will be noted here that for a better understanding, most of like components are designated by like reference numerals throughout the various figures in the embodiments. Attention is directed to FIGS. 1–5 wherein a 25-degree slanted type DIMM connector 10 includes an insulative housing 12 defining a central slot 14 for receiving a card therein. Two rows of cavities 16, 17 (also FIG. 6) are disposed by two sides of the central slot 14 for receiving a corresponding number of contacts 18, 19 therein. Each contact 18, 19 includes a SMT type solder tail 20 extending out of the front/rear surface 22/24 for mounting to the corresponding trace 101 of the mother board 100 (FIG. 10) on which the connector 10 is seated.

A pair of tower 26 are provided at two ends of the housing 12 for respectively receiving a pair of ejectors 28 therein, which perform a ejection or locking function with regard to the card.

The housing 12 further includes three securement sections 30 positioned respective near two opposite tower 26 and the middle portion of the housing 12. Each securement section 30 has a front face 32 and a rear face 34 which are respectively coplanar with the front surface 22 and the rear surface 24. Also referring to FIGS. 6–10, each securement section 30 includes a center aperture 36 extending upward from the bottom surface 37 in a front-to-end direction for receiving a metal holdown 38 therein. The holdown 38 includes a base 41 with barbs 42 thereof for interferential engagement within the aperture 36, and a pair of resilient legs 40 for receipt within the corresponding hole 102 in the mother board 100. Each securement section 30 further includes a pair of apertures 44 extending upward from the bottom surface 37 and by two sides of the center aperture 36 for respectively receiving therein a pair of mounting pads 46 wherein each mounting pad 46 includes a vertical retaining section 48 with barbs 49 thereon for interferential engagement within the corresponding aperture 44, and a horizontal solder section 50 for soldering unto the corresponding trace 104 on the mother board 100.

It can be seen that the solder sections 50 of each pair of mounting pads 46 extend respectively out of the front surface 22 and the rear surface 24 and essentially spaced from the legs 40 of the holdown 38 with substantially an equal distance, thus providing a counterbalance with each other for efficiently resisting any forces, impact or bending moment imposed either on the front side or on the rear side of the housing 12.

Additionally, different from the aforementioned copending application which discloses three enlarged mounting sections on two opposite ends and the middle portion along the housing 12, the securement sections 30 of the housing 12 of the invention keep the same contour dimensions with the main portions of the housing 12 wherein the front face 32 and the rear face 34 of the securement sections 30 are coplanar with the front surface 22 and the rear surface 24 of the housing 12. Under this condition, the outward extending solder sections 50 of the mounting pad 46 should outward protrude not only out of the corresponding front/rear surface 22, 24, but also further out of the imaginary boundary line formed by the tips of the contact solder tails 20 along the same row for preventing damage due to any impact along the lengthwise direction.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A combination of a connector and a mother board, said connector including an elongated insulative housing defining two rows of contacts with solder tails extending out of a front surface and rear surface of the housing, respectively, at least a securement section provided about one end of the housing and including a pair of mounting pads with a corresponding pair of respective horizontally extending solder sections protruding out of the front surface and the rear surface, respectively, and a vertically extending hold down having legs positioned in alignment with and between said pair of solder sections under a condition that a first distance between the hold down leg to one solder section is generally equal to that between the hold down leg to the other solder section, said mother board including a pair of aligned solder traces and a hole corresponding to the solder sections and the holdown wherein a second distance between the hole and one solder trace is generally equal to that between said hole and the other solder trace.

2. The combination as defined in claim 1, wherein said first distance is equal to said second distance.

3. A connector assembly comprising:

an elongated insulative housing defining at least a side surface along a lengthwise direction of the housing;

a plurality of contacts positioned within the housing, each of said contacts including an SMT type solder tail horizontally extending out of said side surface in a transverse direction of the housing;

a pair of mounting pads disposed at two opposite ends of the housing with a row of the solder tails of said contacts positioned therebetween, each of said pair of mounting pads including a horizontally extending solder section extending out of said side surface in said transverse direction; wherein the solder sections of the mounting pads extend outwardly and transversely beyond tips of the solder tails of the contact therebewteen for protection of the solder tails during shipping and handling; wherein said connector further includes a pair of ejectors at said two opposite ends, and said ejectors extend in a non-vertical direction toward said side surface.

4. The connector as defined in claim 3, wherein said mounting pads are made of metal adapted to be soldered to a mother board in an SMT process.

5. The connector as defined in claim 3, wherein said housing defines a central slot exposed to an exterior through said side surface.

6. The connector as defined in claim 3, wherein a third pair of mounting pads are positioned around a middle portion of the housing and extends in said transverse direction.

* * * * *